US006566791B2

(12) United States Patent
Kang

(10) Patent No.: US 6,566,791 B2
(45) Date of Patent: May 20, 2003

(54) PACKING DEVICE FOR CRT FUNNEL

(75) Inventor: Sung-soo Kang, Incheon (KR)

(73) Assignee: Hankuk Electric Glass Co., Ltd., Gumi (KR)

( * ) Notice: Subject to any disclaimer, the term of this patent is extended or adjusted under 35 U.S.C. 154(b) by 192 days.

(21) Appl. No.: 09/768,240

(22) Filed: Jan. 25, 2001

(65) Prior Publication Data

US 2001/0010446 A1 Aug. 2, 2001

(30) Foreign Application Priority Data

Jan. 27, 2000 (KR) ..... 2000-2544

(51) Int. Cl.[7] ..... H01J 31/00
(52) U.S. Cl. ..... 313/2.1; 206/419
(58) Field of Search ..... 313/2.1; 206/421, 206/422, 419, 420

(56) References Cited

U.S. PATENT DOCUMENTS 3,961,707 A * 6/1976 Lehr et al. ..... 206/419
4,241,830 A * 12/1980 Di Gesu' ..... 206/422
4,294,359 A * 10/1981 Berkel ..... 206/422
4,860,894 A * 8/1989 Koenig ..... 206/421

* cited by examiner

*Primary Examiner*—Quana M. Grainger
(74) *Attorney, Agent, or Firm*—Larson & Taylor, PLC

(57) ABSTRACT

Disclosed is a packing device for CRT funnels vertically stacked over and over, receiving a plurality of CRT funnels, comprising a planar supporter having a plurality of through holes, each through hole allowing a neck of the funnel to be inserted therethrough; a pair of first inner walls formed in opposite sides of the supporter, being able to be folded relative to the planar surface of the supporter; and a pair of second inner walls formed in opposite sides of the supporter, being able to be folded relative to the planar surface of the supporter together with the first inner walls, a plurality of foldable lines being formed in at least one of the first and second inner walls, allowing the first and second inner walls to be folded relative to the planar surface of the supporter. With this configuration, there is provided a packing device for CRT funnels having a stiffness enough to support the CRT funnels while the funnels are being transferred, and being stored with reduced volume.

10 Claims, 5 Drawing Sheets

PACKING DEVICE FOR CRT FUNNEL

FIELD OF INVENTION

The present invention relates to a packing device for a CRT funnel.

DESCRIPTION OF RELATED ART

Generally, a CRT (Cathode-ray tube) is comprised of a panel installed in the front thereof, through which pictures are projected, and a funnel installed in rear of the panel, into a neck of which an electron gun is inserted.

Normally, the panel and the funnel are formed from melted glass; and then some portion thereof is polished. After polishing, they are transferred to a different production line to manufacture TVs or monitors, etc.

CRT panels and funnels, which are made from special glass, are comparatively heavy. Considering this property, the panel and the funnel are required to be protected with packing devices in the course of transfer.

There have been known a variety of packing devices. However, the conventional packing device for the funnel is manufactured with a box shape, having a fixed height and size, thereby requiring a large space for storage thereof and making it inconvenient to handle the conventional funnel packing device, thereby increasing the cost of production.

SUMMARY OF THE INVENTION

Accordingly, the present invention has been made keeping in mind the above-described problems, and an object of the present invention is to provide a packing device for a CRT funnel, which has a stiffness enough to support the funnel while the funnel is being transferred, and which requires a small space for its storage.

Another object of the present invention is to provide a packing device for a CRT funnel, which has such a simple construction that it is easy to fold and unfold it, thereby reducing the cost of production.

These and other objects of the present invention may be achieved by a provision of a packing device for CRT funnels vertically stacked over and over, receiving a plurality of CRT funnels, comprising a planar supporter having a plurality of through holes, each through hole allowing a neck of the funnel to be inserted therethrough; a pair of first inner walls formed in opposite sides of the supporter, being able to be folded relative to the planar surface of the supporter; and a pair of second inner walls formed in opposite sides of the supporter, being able to be folded relative to the planar surface of the supporter together with the first inner walls, a plurality of foldable lines being formed in at least one of the first and second inner walls, allowing the first and second inner walls to be folded relative to the planar surface of the supporter.

The device further comprises a pair of first outer walls and a pair of second outer walls respectively formed at outer edges of the first and second inner walls, being wider than the first and second inner walls.

The first and second outer walls are formed integrally with the first and second inner walls.

The first and second outer walls are manufactured separately from the first and second inner walls, and the first and second outer walls are adhered to outer wall surfaces of the first and second inner walls.

Preferably, the device further comprises at least one compartment plate part disposed on the planar surface of the supporter, allowing the received funnels to be isolated from each other.

The compartment plate part is comprised of a first compartment plate disposed in parallel with either of the first or second inner walls, having a foldable line on the surface thereof, allowing the first compartment plate to be folded relative to the planar surface of the supporter; and a second compartment plate provided between the first and second inner walls and the first compartment plate, having one end being adhered to the supporter and the other end being foldable relative to the planar surface of the supporter.

The device further comprises a cover member covering the topmost packing device.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENTS

Figure 1:
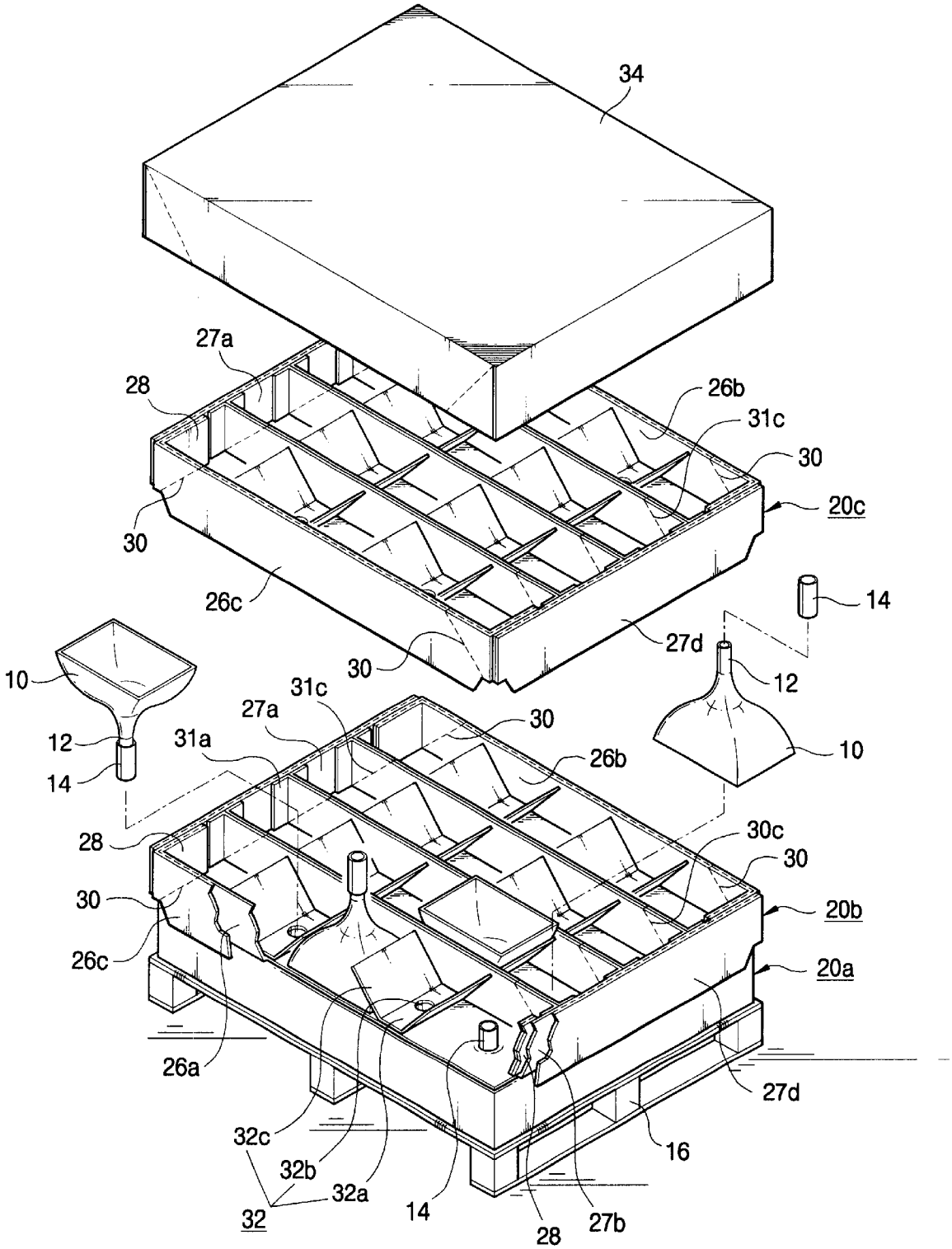
FIG. 1 is a partially exploded perspective view showing an actual use of a CRT funnel packing device according to one embodiment of the present invention.
Figure 2:
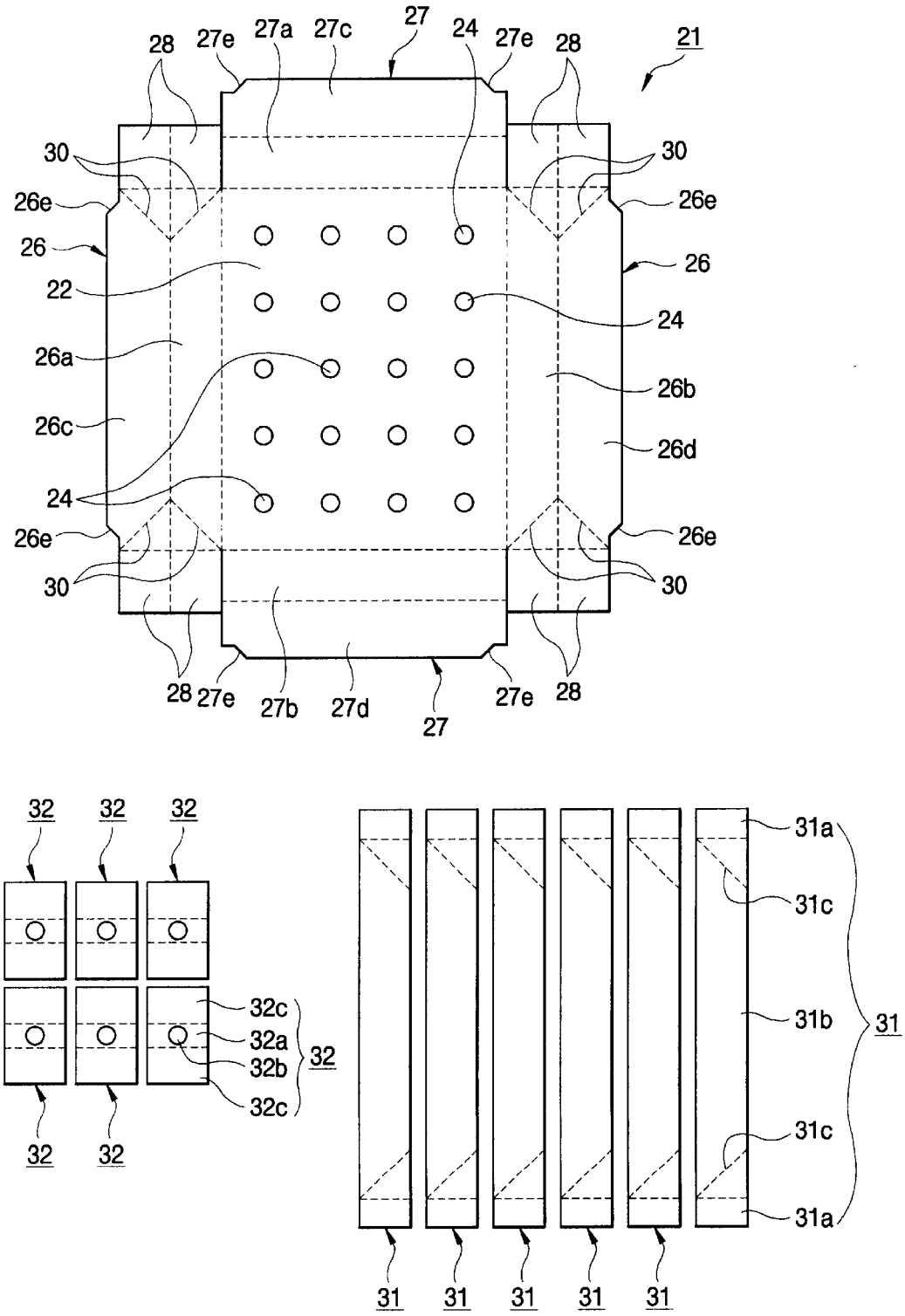
FIG. 2 is an exploded unfolding view of the packing device of FIG. 1.

Referring to FIG. 1, a plurality of CRT funnel packing devices 20*a*, 20*b* and 20*c* according to the present invention are stacked one on another, each receiving a plurality of funnels 10. A cover member 34 is placed on the topmost packing device 20*c*. Each of the packing devices 20*a* through 20*c* is comprised of a main body 21 forming a general space receiving the funnel 10, and a plurality of compartment plates 31 and 32 forming a plurality of funnel receiving spaces.

The main body 21 may be made of a material taking a plate shape, for example, a corrugated cardboard. The main body 21 is comprised of a supporter 22 of a plate shape, having a plurality of through holes 24 through which a neck of the funnel 10 can be inserted thereinto, a pair of first side walls 26 having first inner walls 26*a* and 26*b* integrally formed on opposite sides of the supporter 22, which are foldable longitudinally relative to the planar surface of the supporter 22, and first outer walls 26*c* and 26*d* wider than the first inner walls 26 and 26*b*, which are foldable reversely relative to the first inner walls 26*a* and 26*b*, and a pair of second side walls 27 having second inner side walls 27*a* and 27*b* integrally formed on opposite ends of the supporter 22 transversely relative to the first side walls 26, which are foldable transversely relative to the planar surface of the supporter 22, and second outer walls 27*c* and 27*d* wider than the second inner walls 27*a* and 27*c*, which are foldable reversely relative to the second inner walls 27*a* and 27*c*. The first side walls 26 are to be mutually adhered to the second side walls 27.

After the first and second outer walls 26*c*, 26*d*, 27*c* and 27*d* are folded onto first and second inner walls 26*a*, 26*b*, 27*a* and 27*b*, the outer walls are adhered to the inner walls by an adhesive agent, etc. Thus, the outer walls can be separately manufactured and then adhered to the inner walls.

Any one of the first and second side walls 26 and 27 has a plurality of foldable lines 30 so that the first and second side walls 26 and 27 are folded substantially parallel with the planar surface of the supporter 22. The foldable lines 30 are symmetrically formed with almost 45° relative to a border line between the first inner walls 26*a* through 26*b* and the first outer walls 26*c* and 26*d* at both ends of the first side walls 26.

The lower parts of the first and second outer walls 26*c*, 26*d*, 27*c* and 27*d* are formed with steps 26*e* and 27*e* engaged with the upper portions of the first and second side walls 26 and 27 of the packing device immediately underlaid. Owing to the structure of the first and second side walls 26 and 27, the packing devices 20*a* through 20*c* can be vertically stacked over and over.

The first compartment plates 31 are disposed in parallel with any one of the first and second side walls 26 and 27, between the first and second side walls 26 and 27, forming the receiving spaces and having a foldable line 31*c* on its ends so that it can be folded along with the first and second side walls 26 and 27. The second compartment plates 32 are disposed between the first and second side walls 26 and 27 and the first compartment plates 31, having one end adhered to the supporter 22 and the other end rotable or foldable relative to the planar surface of the supporter 22.

According to one embodiment of the present invention, each first compartment plate 31 is manufactured separately from the main body 21 and disposed in parallel with the first side walls 26. The first compartment plate 31 is comprised of a flange 31*a* adhered to the pair of second inner walls 27*a* and 27*b*, and a compartment 31*b* disposed in parallel with the first side walls 26. The foldable line 31*c* is formed on each end of the compartment 31*b*, having 45° likewise the foldable lines 30 formed in the first side walls 26. Owing to the foldable line 31*c*, when the first and second side walls 26 and 27 are substantially folded relative to the supporter 22, the compartment 31*b* of the first compartment plate 31 can be folded substantially parallel with the planar surface of the supporter 22 owing to the foldable line.

Each second compartment plate 32 is comprised of an adhesive part 32*a* having an opening 32*b* communicating with the through hole 24 formed on the planar surface of the supporter 22 and being adhered to the planar surface of the supporter 22, and a rotation part 32*c* being foldable from an edge of the adhesive part 32*a*. Where the packing device 20*a*, 20*b* or 20*c* is in no use, the rotation part 32*c* is disposed in parallel with the planar surface of the supporter 22. Where the packing device is being used, the rotation part 32*c* is folded to a predetermined degree relative to the adhesive part 32*a*, giving a stiffness between the first side walls 26 and the first compartment plates 31 and between the first compartment plates 31, and preventing a friction between adjacent funnels 10.

The process of assembling the packing devices 21*a* through 21*c* will be described with reference to FIG. 3.

Figure 3:
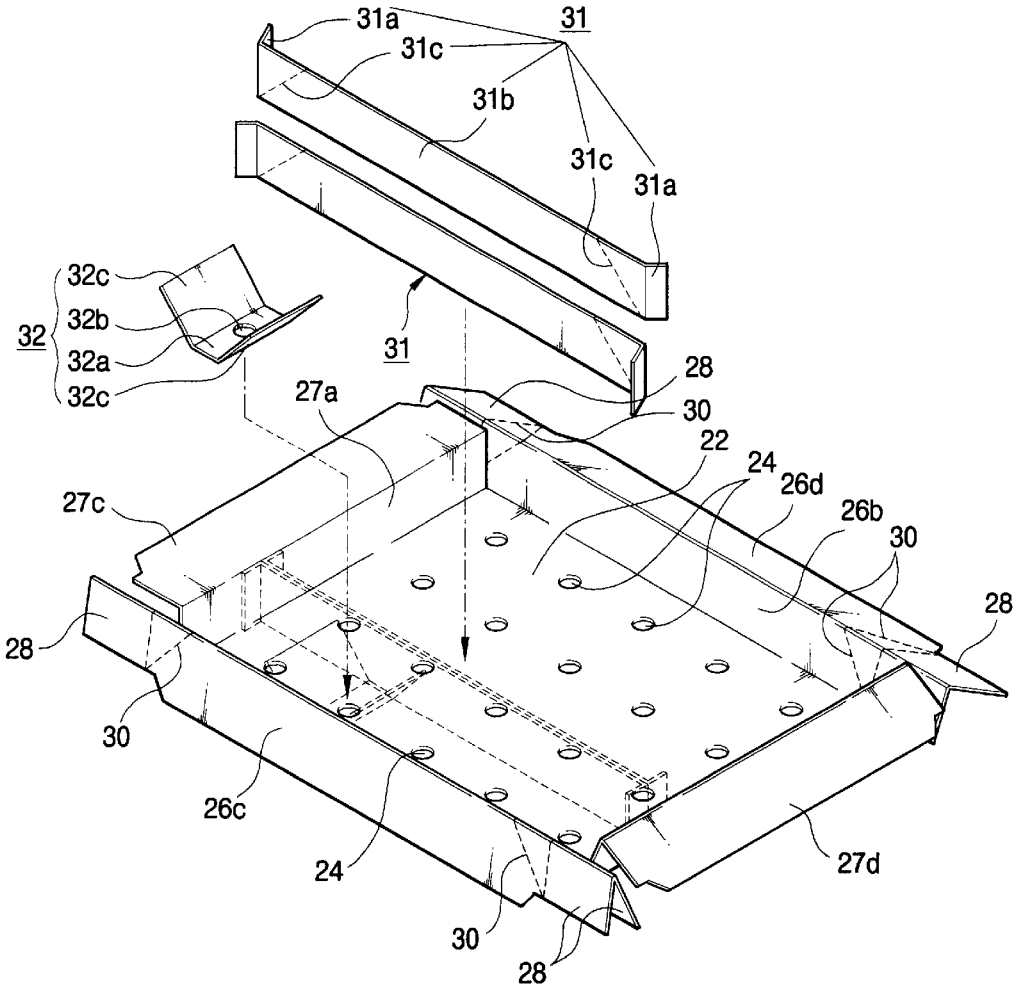
FIG. 3 is an exploded perspective view of the packing device of FIG. 2.

Firstly, the first side walls 26 are erected relative to the supporter 22 from the state that the main body 21 is unfolded as shown in FIG. 3. More specifically, after the first inner walls 26*a* and 26*b* are folded almost perpendicularly relative to the supporter 22, the first outer walls 26*c* and 26*d* are folded oppositely relative to the first inner walls 26*a* and 26*b*, and then the first inner walls 26*a* and 26*b* and the first outer walls 26*c* and 26*d* are adhered each other by an adhesive agent.

After the second inner walls 27*a* and 27*b* are folded almost perpendicularly relative to the supporter 22 and the second outer walls 27*c* and 27*b* are folded reversely, the second inner walls 27*a* and 27*b* and the second inner walls 27*a* and 27*b* are adhered each other, thereby forming the second side walls 27. Then, side flanges 28 formed on opposite ends of the first side walls 26 are adhered to the second inner walls 27*a* and 27*b*, thereby completing the assembly of the first and second side walls 26 and 27.

If the main body 21 is assembled, the first compartment plates 31 are disposed on the supporter 22 in parallel with the first side walls 26 so as to have a predetermined interval, and the flanges 31*a* of the first compartment plate 31 are adhered to the second inner walls 27*a* and 27*b*. The second compartment plates 32 are disposed so as to allow the opening 32*b* formed in the adhesive part 32*a* of the second compartment plate 32 to communicate with the through hole 24 of the supporter 22, between the first and second side walls 26 and 27 and the first compartment plates 31, and between the first compartment plates 31, and the adhesive part 32*a* is adhered to the supporter 22, thereby completing the assembly of the packing devices 20*a* through 20*c*.

If the packing devices 20*a* through 20*c* are assembled, the funnels 10 are disposed within the packing devices 20*a* through 20*c*. The funnels 10 are, as shown in FIG. 1, disposed such that the necks 12 are alternately directed upward and downward. Each neck 12 is inserted into each through hole 24 of the supporter 22 and is exposed to an adjacent packing device. In the lowermost packing device 20*a*, however the funnels 10 are disposed such that the necks 12 are directed upward.

Figure 4:
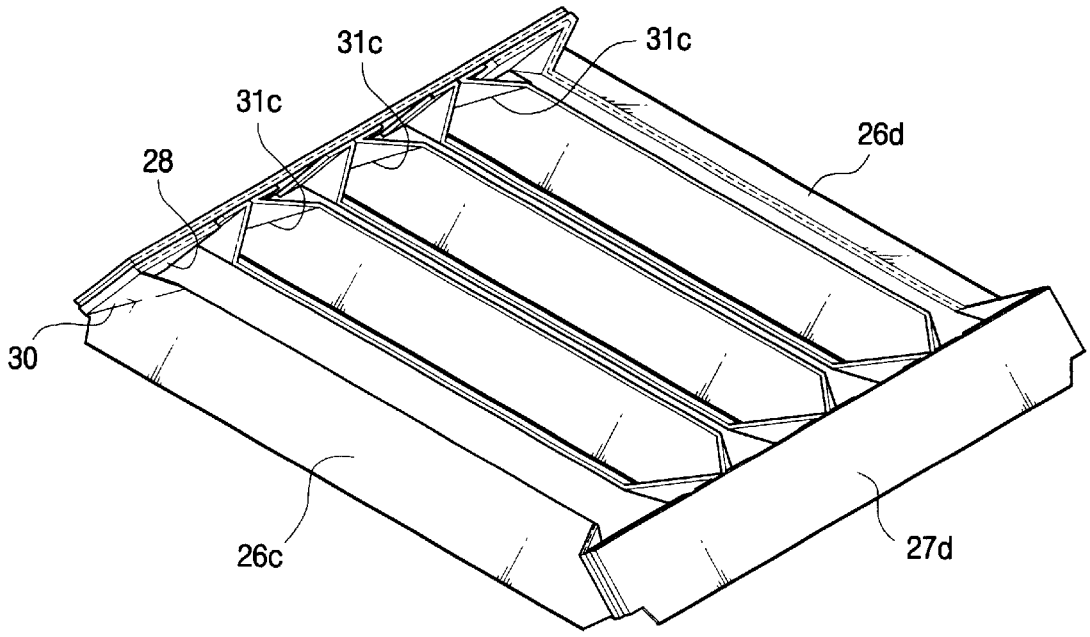
FIG. 4 is a perspective view schematically showing a storage state of the packing device of FIG. 2.

Through the above-described processes, the funnels 10 are received in the respective packing devices 20*a* through 20*c*. When the packing devices 20*a* through 20*c* are placed on a palette 16, as shown in FIG. 1, the lower portions of the first and second outer walls 26*c*, 26*d*, 27*c* and 27*d* of the upper packing devices 20*c* and 20*b* are engaged with the upper portions of the first and second side walls 26 and 27 of the lower packing devices 20*b* and 20*a*, respectively, thereby allowing the plurality of packing devices 20*a* through 20*c* to be stacked over and over vertically. Then, the cover member 34 is placed on the topmost packing device 20*c*.

Where the packing device is in no use any more after the funnels 10 are transferred, the rotation part 32*c* of the second compartment plate 32 is downward rotated so as to be in parallel with the planar surface of the supporter 22, and the first side walls 26 are folded toward the planar surface of the supporter 22, so that the first and second side walls 26 and 27 are folded, to be substantially parallel with the supporter 22 by the foldable lines 30 of the first side walls 26, as shown in FIG. 4. The first compartment plate 31, like the first and second side walls 26 and 27, is folded toward the planar surface of the supporter 22 by the foldable line 31*c*, thereby reducing the packing devices 20*a* through 20*c* in volume and making it easy to store them.

Figure 5:
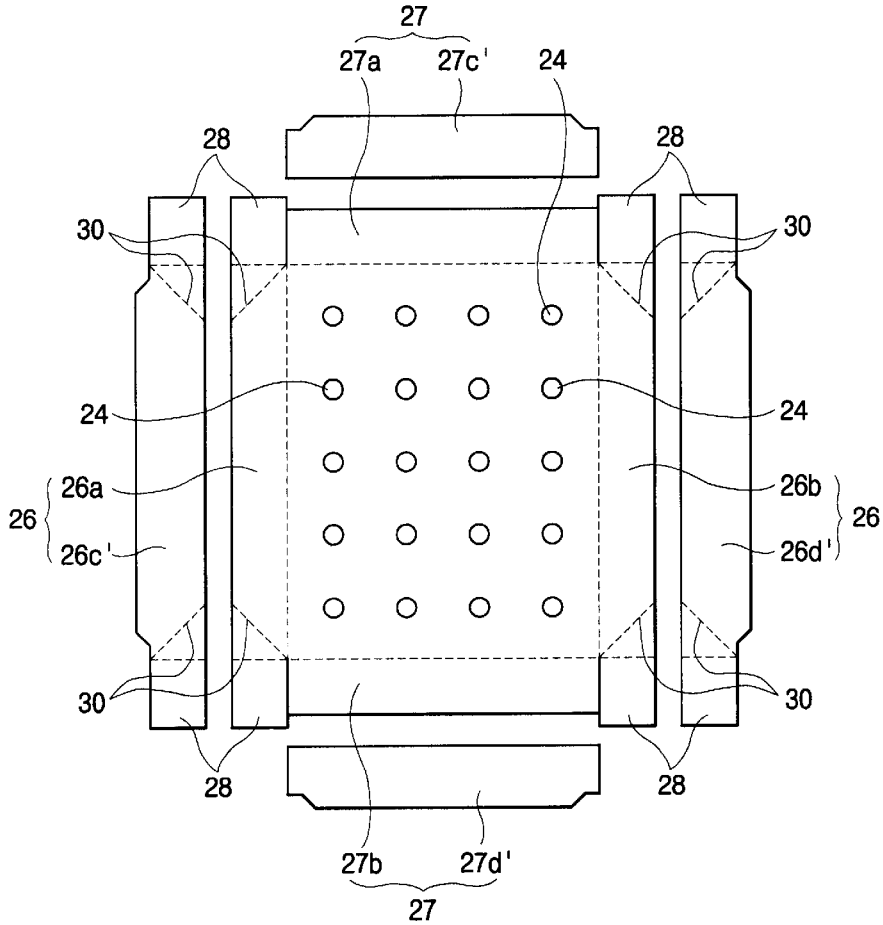
FIG. 5 is an exploded unfolding view of a packing device according to another embodiment of the present invention.
Figure 5:
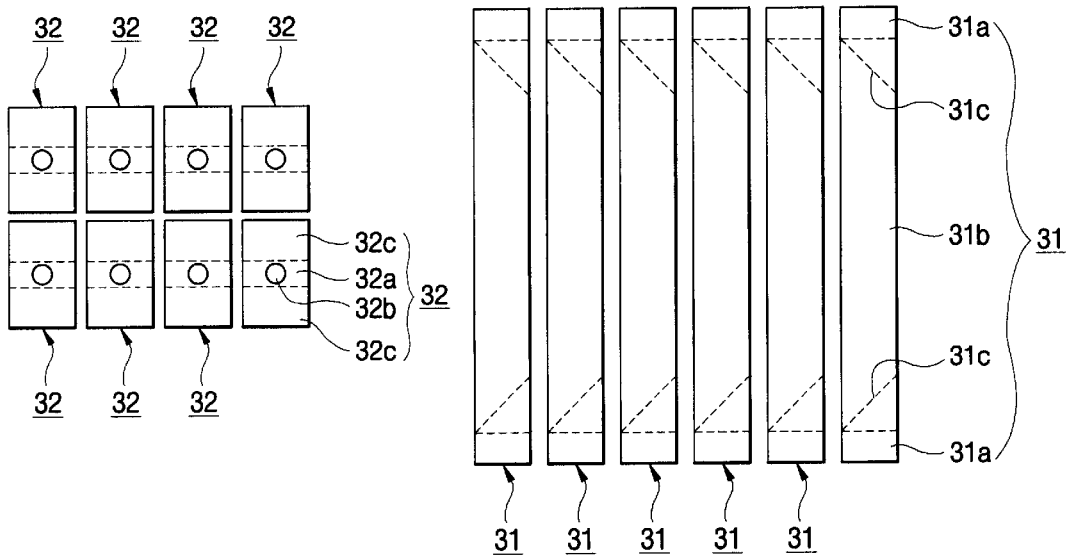

According to a second embodiment of the present invention, packing devices 20*a* through 20*c* have, as shown in FIG. 5, the same construction as the above-described embodiment, except for the construction of the first and second outer walls thereof. The same reference numerals will be employed to describe the same elements and the description thereof will be omitted. The first and second outer walls 26*c*', 26*d*, and 27*c*' and 27*d* are used as reinforcement plates in this embodiment.

Where the main body 21 of the packing device is integrally made of a corrugated cardboard, as in the first embodiment, corrugated directions of the first inner walls

26*a* and 26*b* and the first outer walls 26*c*' and 26*d*' forming the first side walls 26, and the second inner walls 27*a* and 27*b* and the second outer walls 27*c*' and 27*d*' forming the second side walls 27 are identical each other. Since the corrugated cardboard has corrugations of a constant direction, the cardboard can be easily folded at a direction parallel to the corrugations, but it cannot be easily folded at a direction perpendicular to the corrugations.

Considering this property of the corrugated cardboard, the second embodiment of the present invention is comprised of the first and second outer walls 26*c*', 26*d*', 27*c*' and 27*d*' which are formed independently of the first and second inner walls 26*a*, 26*b*, 27*a* and 27*b*, and have a corrugated direction perpendicular to the first and second inner walls 26*a*, 26*b*, 27*a* and 27*b*. With this configuration, the outer walls serve as the reinforcement plates to increase a supportive stiffness of the packing device.

In the above-described embodiments of the present invention, there has been described the folding construction of the packing device. However, the cover member placed upon the topmost of the stacked packing devices can also be folded for storage with reduced volume, by forming foldable lines (indicated as the dotted lines in FIG. 1) thereon.

In the above-described embodiments, there has merely been described the three-stacked packing devices 20*a* through 20*c* for the sake of convenience of drawings and description of the invention. However, the packing devices can be stacked less than or more than three, as necessary.

As described above, the packing device for CRT funnels according to the present invention has a stiffness enough to support the CRT funnels while the funnels are being transferred, and can be stored with reduced volume.

The packing device for CRT funnels has also such a simple construction that it is easy to fold and unfold it, thereby reducing the cost of production and further reducing the packing cost and the storage cost.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A packing device for ORT funnels vertically stacked over and over, receiving a plurality of ORT funnels, comprising:

a planar supporter having a plurality of through holes, each through hole allowing a neck of the funnel to be inserted therethrough;

a pair of first inner walls formed in opposite sides of the supporter, being able to be folded relative to the planar surface of the supporter; and a pair of second inner walls formed in opposite sides of the supporter, being able to be folded relative to the planar surface of the supporter together with the first inner walls, a plurality of foldable lines being formed in at least one of the first and second inner walls, allowing the first and second inner walls to be folded relative to the planar surface of the supporter, said device further comprising a pair of first outer walls and a pair of second outer walls respectively formed at outer edges of the first and second inner walls, said first and second outer walls being wider than the first and second inner walls.

2. The device according to claim 1, wherein the first and second outer walls are formed integrally with the first and second inner walls.

3. The device according to claim 2, further comprising a cover member covering the topmost packing device.

4. The device according to claim 1, wherein the first and second outer walls are manufactured separately from the first and second inner walls, and the first and second outer walls are adhered to outer wall surfaces of the first and second inner walls.

5. The device according to claim 4, further comprising a cover member covering the topmost packing device.

6. The device according to claim 1, further comprising at least one compartment plate part disposed on the planar surface of the supporter, allowing the received funnels to be isolated from each other.

7. The device according to claim 5, wherein the compartment plate part is comprised of:

a first compartment plate disposed in parallel with either of the first or second inner walls, having a foldable line on the surface thereof, allowing the first compartment plate to be folded relative to the planar surface of the supporter; and a second compartment plate provided between the first and second inner walls and the first compartment plate, having one end being adhered to the supporter and the other end being foldable relative to the planar surface of the supporter.

8. The device according to claim 7, further comprising a cover member covering the topmost packing device.

9. The device according to claim 6, further comprising a cover member covering the topmost packing device.

10. The device according to claim 1, further comprising a cover member covering the topmost packing device.

* * * * *

UNITED STATES PATENT AND TRADEMARK OFFICE

CERTIFICATE OF CORRECTION

PATENT NO. : 6,566,791 B2
DATED : April 29, 2003
INVENTOR(S) : Donald E. Oinen

It is certified that error appears in the above-identified patent and that said Letters Patent is hereby corrected as shown below:

Column 11,
Line 55, change "mh" to -- $m^{th}$ --

Column 12,
Line 40, delete "object in"

Signed and Sealed this

Eleventh Day of January, 2005

JON W. DUDAS
*Director of the United States Patent and Trademark Office*